United States Patent [19]

Moll

[11] Patent Number: 4,600,185

[45] Date of Patent: Jul. 15, 1986

[54] APPARATUS FOR DETECTING AND ACTUATING THE FEEDING OF PAPER IN PAPER FOLDING MACHINES

[76] Inventor: Richard J. Moll, c/o Dick Moll and Sons, 415 Constance Dr., Warminster, Pa. 18974

[21] Appl. No.: 680,816

[22] Filed: Dec. 12, 1984

Related U.S. Application Data

[63] Continuation-in-part of Ser. No. 528,438, Sep. 1, 1983, abandoned.

[51] Int. Cl.[4] ..... B65H 39/02; G01W 21/86

[52] U.S. Cl. ..... 270/58; 250/211 R; 250/561; 250/571

[58] Field of Search ..... 270/45, 55, 58; 271/110–111, 149, 154–155; 250/234, 522.1, 200, 206, 211 R, 557, 548, 563, 571, 216, 561, 454.1, 223 R; 400/703, 708; 307/425

[56] References Cited

U.S. PATENT DOCUMENTS

| | | | |
|---|---|---|---|
| 3,085,160 | 4/1963 | Dahms | 250/234 |
| 3,495,089 | 2/1970 | Brown | 250/561 |
| 3,617,759 | 11/1971 | Martin | 250/234 X |
| 3,881,107 | 4/1975 | Bory | 250/234 |
| 3,906,240 | 9/1975 | Jeffree | 250/561 X |
| 4,229,650 | 10/1980 | Takahashi et al. | 250/561 |
| 4,268,021 | 5/1981 | Rutishauser | 271/110 X |
| 4,286,149 | 8/1981 | Bennathan et al. | 250/223 R |
| 4,320,394 | 3/1982 | John, Jr. | 250/206 X |
| 4,369,363 | 1/1983 | Quint et al. | 250/211 R |
| 4,417,148 | 11/1983 | Otake | 250/223 R |

FOREIGN PATENT DOCUMENTS

| | | | |
|---|---|---|---|
| 18797 | 2/1979 | Japan | 271/110 |
| 135038 | 10/1980 | Japan | 271/110 |
| 70247 | 6/1981 | Japan | 271/110 |
| 161243 | 12/1981 | Japan | 271/110 |

*Primary Examiner*—E. M. Eickholt

*Attorney, Agent, or Firm*—Z. T. Wobensmith, III

[57] ABSTRACT

Apparatus is disclosed for paper feeding machines for detecting the presence of a load of paper to be fed, and which actuates the feeder to cause paper to be advanced for folding or other operations when no load is detected, and which apparatus includes a scanning head to detect the presence of a load of paper, and electrical circuitry to provide emission signals to the scanning head, compare received signals at the scanning head and, if the signals match, to open a relay and cause the feeder to stop moving a load of paper to position for picking off sheets and further operations such as folding until no load is detected and feeding is resumed.

2 Claims, 3 Drawing Figures

APPARATUS FOR DETECTING AND ACTUATING THE FEEDING OF PAPER IN PAPER FOLDING MACHINES

CROSS REFERENCE TO RELATED APPLICATION

This application is a continuation-in-part of my prior application Ser. No. 528,438, filed Sept. 1, 1983, and now abandoned.

BACKGROUND OF THE INVENTION

1. Field of the Invention

This invention relates to apparatus for detecting the presence of, and actuating the feeding of sheets of paper in paper folding machines and the like.

2. Description of the Prior Art

In paper folding and other like machines it is important that the stack of paper be fed uniformly to the location where the individual sheets are removed from the stack or load, and then individually folded or creased. Paper sheets due to atmospheric or other conditions can easily stick together, curl up and jam the machine if the stack is advanced too fast, and if the stack is not advanced fast enough, time is wasted and unnecessary expense results. Most paper folding machines use a micro-switch with a protruding arm, that is engaged by the stack of paper, and signals the feeder to advance the paper for folding but such devices are not precise in operation. Should the edge of the paper curl up and not engage the arm, then the paper stack will over-feed and the stack will jam the machine. Should the paper edge curl down, the switch arm will be contacted and cause the sheet to be distorted. The difficulties encountered with available mechanical devices requires the operators constant attention to the machine, and increases the cost to the customer.

Other devices have been proposed, such as shown in Motokawa Japanese Pat. No. 161,243 wherein a device is provided to prevent the improper feeding of two or more pieces of paper in a printing machine. The Motokawa device requires that the sheets of paper pass over a light emitting device with a detector on the other or receiving side, and which quantity of light penetrating the paper sheets is determined and compared to a memory value and if lower, then paper feeding is stopped and the machine cleared. This device does not detect the presence of the load of paper like that of my invention, is not suitable for opaque paper and suffers from other problems.

The U.S. Pat. to Brown No. 3,495,089 discloses alignment sensing devices which utilize light-emitting semiconductors. The device is used for web edge aligning and includes a light-emissive semi-conductive device which is stimulated to emit radiation of a predetermined spectral characteristic along a sensing path, and with a radiation sensing structure above it, which receives the radiation, and provides a sensing output in accordance with the detected variations of the web or other structure, which variations affect the radiation path. No structure which is self contained and detects the presence of a load of paper is provided, in Brown nor would Brown be suitable for use in paper folding machines.

Similar devices where a light path is broken are shown in the U.S. Pat. to Jefree No. 3,906,240 and Martin No. 3,617,759 but they do not sense the presence of a load of paper, as is accomplished by my device and are not suitable for use in paper folding machines.

The device of my invention does not touch the load or stack of paper, does not require the breaking of a beam of energy with emitters and detectors between which objects must pass, and is suitable for providing precision control of paper feeding for paper folding machines and the like.

SUMMARY OF THE INVENTION

In accordance with the invention apparatus for detecting the presence of and actuating the feeding of sheets of paper in folding machines and the like is provided.

The principal object of the invention is to provide apparatus for detecting the presence of and actuating the feeding of paper in folding machines and the like that can be used with a wide variety of machines, and is easily positioned or repositioned for use.

A further object of the invention is to provide apparatus of the character aforesaid which does not physically touch the stack or load of paper to be fed.

A further object of the invention is to provide apparatus of the character aforesaid that can be easily attached and detached from the machine on which it is used.

A further object of the invention is to provide apparatus of the character aforesaid that is quick and positive in operation.

A further object of the invention is to provide apparatus of the character aforesaid that is simple to construct but sturdy and reliable in use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 2:
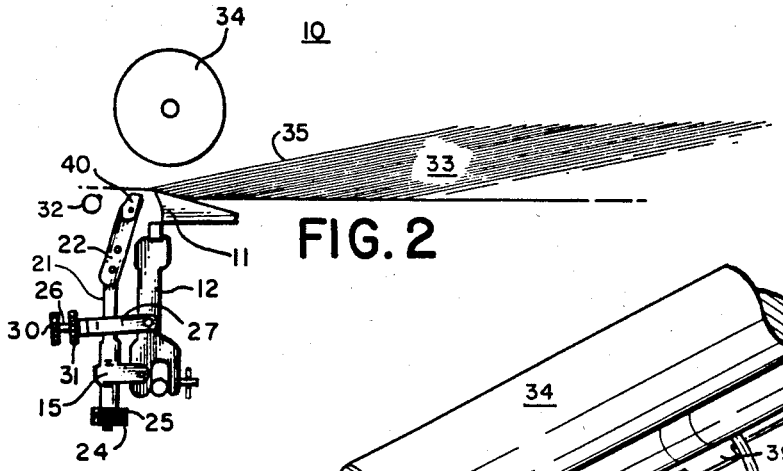
FIG. 2 is an end elevational view, in diagrammatic form, of the apparatus of FIG. 1.
Figure 1:
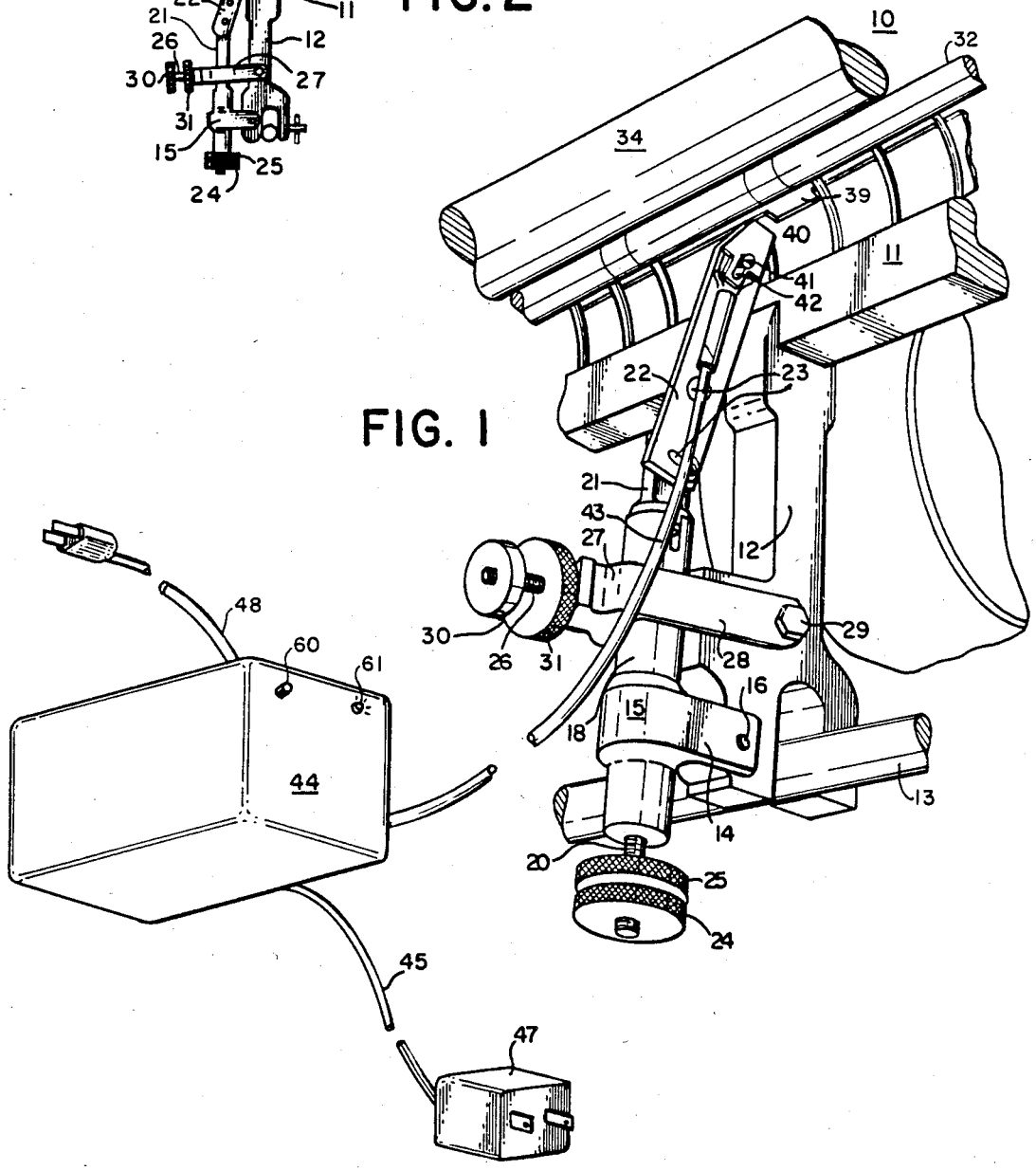
FIG. 1 is a view in perspective illustrating the apparatus of my invention mounted on a typical folding machine.
Figure 3:
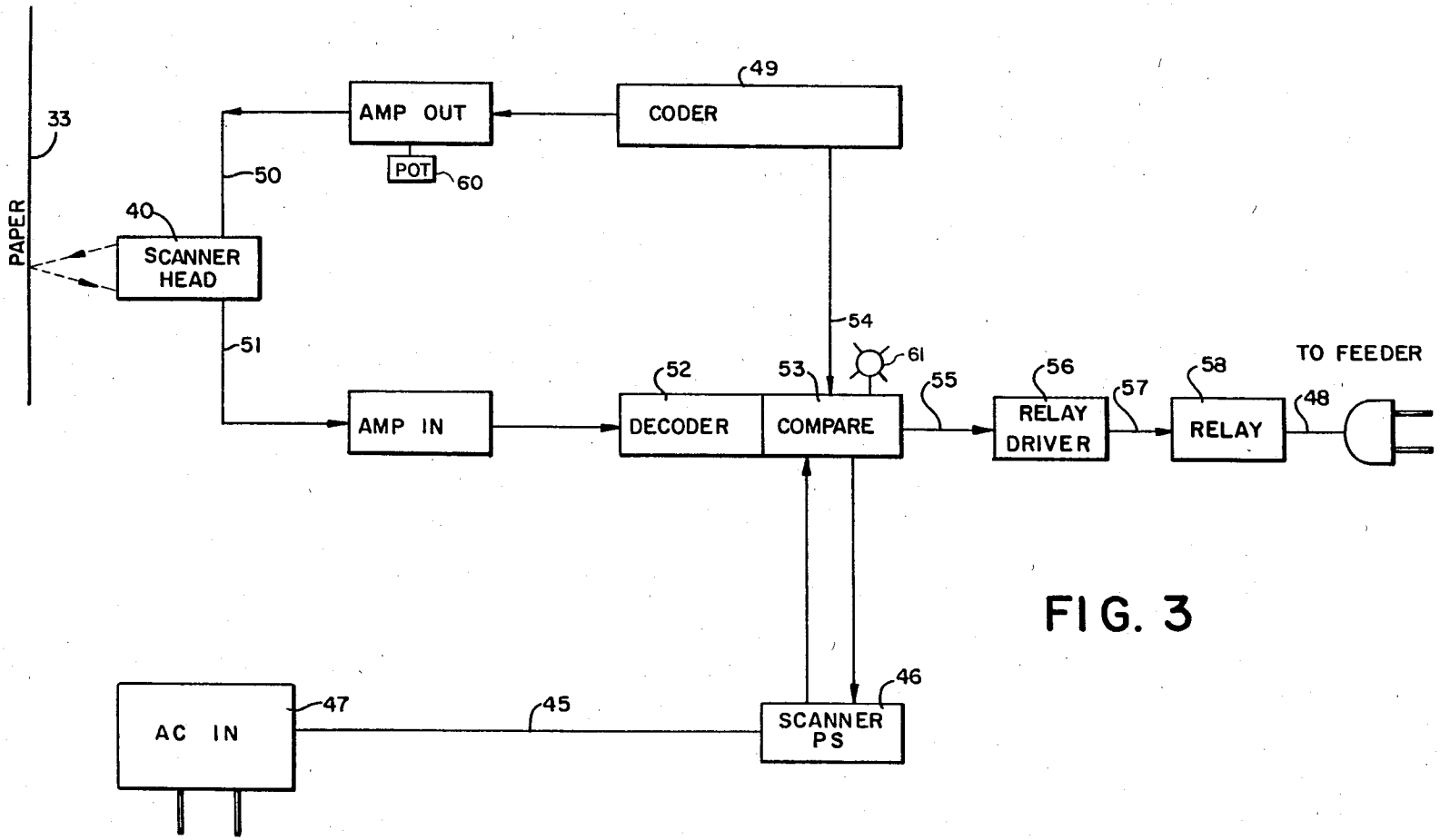
FIG. 3 is a diagrammatic view in block form of the electrical circuitry of the apparatus of my invention.

Referring now more particularly to the drawings and FIGS. 1 and 2 thereof, a portion of a folding machine 10 is illustrated which includes a frame 11, and frame rails 12 and 13.

The rail 12 has the arms 14 of a mounting bracket 15 engaged therewith, by a pin 16, which permits limited rotational bracket movement thereabout.

The bracket 15 includes a cylindrical portion 18, which as shown extends vertically with a threaded shaft 20 engaged therewith, which also extends vertically upwardly, as shown in FIG. 1, to an upper extension 21 to which an arm 22 is secured by bolts, (not shown)

carried in slots 23, permitting limited adjustment of the position of arm 22 with respect to the upper extension 21.

The shaft 20 has knurled nuts 24 and 25 engaged therewith, with nut 24 fixed to the end of shaft 20 for rotation thereof and with nut 25 normally free to rotate on shaft 20 for locking of the shaft.

The rotation of shaft 20 being effective for changing the vertical position of the upper extension 21.

The cylindrical portion 18 has a threaded shaft 26 engaged therewith, and with a fork 27, which has extensions 28 attached to the rail 12 by a bolt 29.

The shaft 26 has knurled nuts 30 and 31 engaged therewith, with nut 30 fixed to shaft 26 for rotation thereof, and nut 31 free to move to a position for locking of shaft 26. The movement of shaft 26 causes the mounting bracket 15 to rotate about pin 16, for movement towards and away from the rail 12.

It will be appreciated that movement of shafts 20 and 26, and adjustment of arm 22 on extension 21 permits precise positioning of the upper end of arm 22 relative to an opening 39 in the underside of frame 11.

The machine 10 includes an air bar 32 which provides a source of air against a load of paper 33 carried on the machine 10, and includes an air suction wheel 34 to pick off sheets of paper 35 from the load 33, as they are lifted up by the air flow from the air bar 32.

A scanning head 40 is mounted to the upper end of arm 22 by a bolt 41 carried in a slot 42 which provides limited adjustment of the head 40 with respect to the arm 22. Scanner header 40 is positioned adjacent to underside of paper load 33 adjacent opening 39 in order to read the paper load 33 from the bottom. The scanner head 40 has a cable 43 attached thereto and to a control box 44. The control box 44 has a power input line 45 which is connected to a power supply 46, and to a low voltage transformer 47, of well known type which can be connected to a source of electrical power (not shown).

An output cable 48 is provided extending from box 44 to a feeder (not shown) of well known type to cause the feeder to operate as described below.

The control box 44 includes well known circuitry for providing a coded pulsed electrical signal from coder 49 to the scanner head 40, through wire 50 in cable 43, so that the structure in head 40 emits a pulsed controlled light signal in the infrared light spectrum, in a preset amount which light can strike the load of paper 33 if one is present, and which can be varied by adjustment of the potentiometer 60 to change the signal strength. While the signal strength is preset and will read the load correctly for most items, if the sheets to be folded are dark, then the signal strength must be increased to read the load. The signal striking the load 33 is reflected back to the head 40, where it is detected and the electrical signal carried back through wire 51, to a decoder 52, where the received signal is compared in a comparator 53, to the coded signal from coder 49 which is connected to the comparator 53 by wire 54. If the reflected signal is correct, the load 33 is present, the light 61 is lit, and a signal is sent out over wire 55 to a relay driver 56, which sends a signal over wire 57 to relay 58, to actuate a circuit in the relay 58 which through wire 48 opens a circuit in the feeder (not shown) to cause the paper load 33 to not be advanced.

The scanner head 40 and the electrical circuitry contained in the control box 44 are well known and available from many sources, such as model 703 scanner head, and model M04REVO control box, as Microtronics, Inc. of Indianapolis, Ind.

When the signal from head 40 does not strike the load of paper 33 within the preset tolerance range then the circuitry of relay 58 circuit is closed, and the feeder (not shown) operates to advance the paper load 33 until its presence is detected by scanner head 40. Individual sheets of paper 35 are lifted up by the air from air bar 32 and picked off by wheel 34 which advances them into the machine 10 for folding or other operation. The operation can continue as described. It should be noted that the scanner head 40 is positionable through the vertical and horizontal adjustment of bracket 15, and adjustment of the potentiometer 60 permits of precision adjustment of the emitted signal strength with respect to the load of paper 33 so that proper feeding occurs, and in the preferred embodiment will reflect back over a tolerance of $\frac{1}{4}$ inch.

It will thus be seen that apparatus has been provided with which the objects of the invention are attained.

I claim:

1. In combination with a folding machine for folding paper and the like, said folding machine including paper feeding means, apparatus for detecting the presence of a load of paper which comprises an adjustable mounting bracket secured to the underside of said machine, scanning means carried by said mounting bracket adjacent to the underside of the paper to detect the presence of a load of paper, said scanning means including a scanning head capable of emitting a series of coded light pulses and receiving the light pulses which are reflected by the paper when present, said scanning means providing an electrical detection signal upon reception of a reflected light pulse;

control means connected to said scanning means to provide and receive signals therefrom, compare said signals, and provide an output signal to the paper feeding means, whereby the paper feeding means carried by said folding machine is controlled, said control means including a coder connected to said scanning head for providing a series of coded electrical pulse signals to the scanning head, a decoder connected to the scanning head to receive the electrical detection signals from the scanning head, a comparator connected to the coder and decoder to compare the electrical pulse signals and the electrical detection signals and provide an output signal indicative of matching coded signals, a relay driver connected to the comparator to receive the comparator output signal and provide an output signal, a relay connected to the relay driver to receive the output signal from the relay driver, and means connected to the relay to cause the feeding means to operate upon receipt of a signal from the relay; and adjustment means connected to said control means for adjusting the strength of the coded light pulses from the coder.

2. Apparatus as defined in claim 1 in which said mounting bracket comprises means for vertically adjusting the position of said scanning means relative to the paper and means for horizontally adjusting the position of said scanning means relative to the paper.

* * * * *

UNITED STATES PATENT AND TRADEMARK OFFICE

CERTIFICATE OF CORRECTION

PATENT NO. : 4,600,185

DATED : July 15, 1986

INVENTOR(S) : RICHARD J. MOLL

It is certified that error appears in the above—identified patent and that said Letters Patent is hereby corrected as shown below:

Column 3,

Line 31, after "adjacent to", insert --the--.

Column 4,

Line 1, after "as", insert --manufactured by--.

Signed and Sealed this

Twenty-first Day of October, 1986

[SEAL]

*Attest:*

DONALD J. QUIGG

*Attesting Officer*

*Commissioner of Patents and Trademarks*